US007893896B2

(12) United States Patent
Choi

(10) Patent No.: US 7,893,896 B2
(45) Date of Patent: Feb. 22, 2011

(54) LIGHT EMITTING DISPLAY HAVING DECREASED PARASITIC CAPACITANCE

(75) Inventor: Woong Sik Choi, Kyunggi-do (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1013 days.

(21) Appl. No.: 11/158,099

(22) Filed: Jun. 22, 2005

(65) Prior Publication Data

US 2006/0001620 A1 Jan. 5, 2006

(30) Foreign Application Priority Data

Jun. 25, 2004 (KR) ..... 10-2004-0048311

(51) Int. Cl.
*G09G 3/32* (2006.01)

(52) U.S. Cl. ..... 345/82; 345/76

(58) Field of Classification Search ..... 345/46, 345/44, 55, 76, 82, 45, 77, 84; 315/169.3; 313/463

See application file for complete search history.

(56) References Cited

U.S. PATENT DOCUMENTS 5,550,066 A * 8/1996 Tang et al. ..... 438/29
6,229,508 B1 * 5/2001 Kane ..... 345/82
6,583,581 B2 * 6/2003 Kaneko et al. ..... 315/169.3
6,618,029 B1 * 9/2003 Ozawa ..... 345/82
6,742,762 B2 * 6/2004 Koyama ..... 251/59
6,900,784 B2 * 5/2005 Tsuchida ..... 345/76
7,230,375 B2 * 6/2007 Park et al. ..... 313/506
2001/0038367 A1 * 11/2001 Inukai ..... 345/76
2002/0021266 A1 * 2/2002 Koyama et al. ..... 345/76
2002/0050962 A1 * 5/2002 Kasai ..... 345/76
2002/0154084 A1 10/2002 Tanaka et al.
2003/0007108 A1 1/2003 Hwang et al.
2003/0117352 A1 * 6/2003 Kimura ..... 345/87
2003/0137622 A1 * 7/2003 Song ..... 349/110

FOREIGN PATENT DOCUMENTS

JP 2001-35662 2/2001

* cited by examiner

*Primary Examiner*—Chanh Nguyen
*Assistant Examiner*—Pegeman Karimi
(74) *Attorney, Agent, or Firm*—H.C. Park & Associates, PLC

(57) ABSTRACT

A light emitting display including a plurality of scan lines; a plurality of data lines crossing the scan lines; a plurality of pixels defined by the scan lines and the data lines; and a light emitting device formed on a pixel and comprising a first electrode and a second electrode. A pixel connected to an $n^{th}$ data line includes a switching transistor that turns on in response to a selection signal supplied from a scan line; a storage capacitor to store a voltage corresponding to a data signal supplied from the $n^{th}$ data line when the switching transistor is turned on; and a driving transistor to supply a current corresponding to the voltage stored in the storage capacitor to the first electrode. The storage capacitor is formed between the first electrode and an $(n+1)^{th}$ data line.

5 Claims, 7 Drawing Sheets

LIGHT EMITTING DISPLAY HAVING DECREASED PARASITIC CAPACITANCE

CROSS-REFERENCE TO RELATED APPLICATION

This application claims priority to and the benefit of Korean Patent Application No. 10-2004-0048311, filed on Jun. 25, 2004, which is hereby incorporated by reference for all purposes as if fully set forth herein.

BACKGROUND

1. Field of the Invention

The present invention relates to a light emitting display, and more particularly, to a light emitting display having decreased parasitic capacitance.

2. Discussion of the Background

Various flat panel displays have been recently developed to replace the heavier and bulkier cathode ray tube (CRT). Such displays include the liquid crystal display (LCD), field emission display (FED), plasma display panel (PDP), light emitting display (LED), etc.

Among flat panel displays, the self-emissive light emitting display utilizes electron-hole recombination in a fluorescent layer to emit light. Such a light emitting display has a relatively fast response time, and it consumes relatively less power.

Referring to FIG. 1, a light emitting display may comprise a plurality of pixels 10 that receive a data signal from a data line Dn in response to a selection signal of a scan line Sm and emit light corresponding to the received data signal.

Here, each pixel 10 may include an organic light emitting device OLED, the data line Dn, the scan line Sm, and a pixel circuit 12 connected to an anode of the organic light emitting device OLED.

The organic light emitting device OLED may include the anode, an emitting layer formed on the anode, and a cathode formed on the emitting layer. The anode is connected to the pixel circuit 12, and the cathode may be connected to a second power line VSS. The emitting layer, which comprises at least a light emitting layer, may also include an electron transport layer interposed between the emitting layer and the cathode and a hole transport layer interposed between the emitting layer the anode. Additionally, the organic light emitting display OLED may comprise an electron injection layer and a hole injection layer. In such an organic light emitting display OLED, applying a voltage between the anode and the cathode generates electrons from the cathode, which move to the emitting layer via the electron injection layer and the electron transport layer, and holes from the anode, which move to the emitting layer via the hole injection layer and the hole transport layer. The electrons and holes then recombine in the emitting layer, thereby causing light to be emitted.

The pixel circuit 12 comprises a driving thin film transistor (TFT) MD connected between the first power line VDD and the organic light emitting device OLED, a switching TFT MS connected to the driving TFT MD, the data line Dn and the scan line Sm, and a storage capacitor Cst connected between gate and source electrodes of the driving TFT MD. Here, the driving TFT MD and the switching TFT MS are shown as P-type metal oxide semiconductor field effect transistors (MOSFET).

The switching TFT MS comprises a gate electrode connected to the scan line Sm, a source electrode connected to the data line Dn, and a drain electrode connected to a first terminal of the storage capacitor Cst. Here, the switching TFT MS turns on in response to the selection signal of the scan line Sm, and supplies the data signal from the data line Dn to the storage capacitor Cst, which stores a voltage corresponding to the supplied data signal.

The driving TFT MD comprises the gate electrode connected to the first terminal of the storage capacitor Cst, the source electrode connected to a second terminal of the storage capacitor Cst and the first power line VDD, and a drain electrode connected to the anode of the organic light emitting device OLED. Here, the driving TFT MD supplies a current to the organic light emitting device OLED corresponding to the voltage stored in the storage capacitor Cst, and the organic light emitting device OLED emits light corresponding to the current supplied from the driving TFT MD.

However, in such a conventional light emitting display, parasitic capacitors CP1 and CP2 of each pixel 10 may cause decreased picture quality. Referring to FIG. 1 and FIG. 2, in the pixel 10 connected to the $n^{th}$ data line Dn (where n is a natural number), the first parasitic capacitor CP1 is formed between the storage capacitor Cst and the $n^{th}$ data line Dn, and the second parasitic capacitor CP2 is formed between the anode of the organic light emitting device OLED and the $n^{th}$ data line Dn.

Hence, in the pixel 10 connected to the $n^{th}$ data line Dn, the first parasitic capacitor CP1 and the second parasitic capacitor CP2 are connected to the $n^{th}$ data line Dn. Thus, when a data signal is supplied to the data line Dn in response to the selection signal, the first and second parasitic capacitors CP1 and CP2 may vary the voltage applied to the pixel 10, thereby deteriorating picture quality. Particularly, to secure a sufficient aperture ratio, the anode and the data line Dn, and the storage capacitor Cst and the data line Dn, are formed as close as possible (refer to FIG. 2), respectively. However, the closer these elements are formed, the more the capacity of the first and second parasitic capacitors CP1 and CP2 increases, thereby further deteriorating picture quality.

Additionally, in the pixel 10 of FIG. 1, the TFTs may have different threshold voltages Vth, which increases the difficulties in representing high gradation. A light emitting display, such as that shown in FIG. 3, has been proposed to solve this problem.

Referring to the light emitting display of FIG. 3, a pixel 20 is selected when the selection signal is applied to the scan line Sm, and it emits light corresponding to the data signal applied to the data line Dn.

Each pixel 20 may include the organic light emitting device OLED, and a pixel circuit 22 that drives the organic light emitting device OLED to emit light. The pixel circuit 22 is connected to the data line Dn, the scan line Sm and an emitting control line EMIm.

The organic light emitting device OLED may include an anode connected to the pixel circuit 22, and the cathode connected to a second power line VSS. Here, the organic light emitting device OLED emits light corresponding to the current supplied from the pixel circuit 22.

The pixel circuit 22 comprises the driving TFT MD connected between the first power line VDD and the organic light emitting device OLED; the emitting control line EMIm; a fourth switching device MS4 connected to the organic light emitting device OLED and the driving TFT MD; a first switching device MS1 connected to the $m^{th}$ scan line Sm and the $n^{th}$ data line Dn; a second switching device MS2 connected to the first switching device MS1, the first power line VDD and the $(m-1)^{th}$ scan line Sm−1; a third switching device MS3 connected to a first node N1 between the driving TFT MD and the fourth switching device MS4, the $(m-1)^{th}$ scan line Sm−1, and the gate electrode of the driving TFT MD; the storage capacitor Cst connected to a second node N2 between the first and second switching devices MS1 and MS2, and the first power line VDD; and a compensation capacitor Cvth connected between the second node N2 and the driving TFT MD. Here, the driving TFT MD and the switching transistors MS1, MS2, MS3 and MS4 are shown as P-type MOSFETs.

The pixel 20 may be driven as follows. Referring to FIG. 4, for a period of T1, a low selection signal SS is supplied to the $(m-1)^{th}$ scan line Sm−1 while supplying a high level signal to the $m^{th}$ scan line Sm. Further, a high light emission signal EMI is supplied to the emitting control line EMIm. When supplying the low selection signal SS to the $(m-1)^{th}$ scan line Sm−1, the second and third switching devices MS2 and MS3 are turned on. When supplying the high level signal to the $m^{th}$ scan line Sm, the first switching device MS1 is turned off, and when supplying the high light emission signal EMI to the emitting control line EMIm, the fourth switching device MS4 is turned off.

For the period of T1, in which the second and third switching devices MS2 and MS3 are turned on, the driving TFT MD functions as a diode, and a voltage applied between the gate and source electrodes of the driving TFT MD varies until it reaches the threshold voltage of the driving TFT MD. Accordingly, the compensation capacitor Cvth stores a compensation voltage corresponding to the threshold voltage Vth of the driving TFT MD.

For a period of T2, the high level signal is supplied to the $(m-1)^{th}$ scan line Sm−1, and the low selection signal SS is supplied to the $m^{th}$ scan line Sm. Further, the high light emission signal EMI is supplied to the emitting control line EMIm. When supplying the high level signal to the $(M-1)^{th}$ scan line Sm−1, the second and third switching devices MS2 and MS3 are turned off. When supplying the low selection signal SS to the $m^{th}$ scan line Sm, the first switching device MS1 is turned on. When supplying the high light emission signal EMI to the emitting control line EMIm, the fourth switching device MS4 remains turned off.

For the period of T2, in which the first switching device MS1 is turned on, the data signal may be supplied from the data line Dn to the second node N2 through the first switching device MS1, thereby charging the storage capacitor Cst with a voltage corresponding to the data signal. At this time, the gate electrode of the driving TFT MD is supplied with the sum of the voltage (i.e. Vdata-VDD) charged in the storage capacitor Cst and the compensation voltage charged in the compensation capacitor Cvth. That is, in the light emitting display of FIG. 3, the compensation capacitor Cvth is charged with the voltage corresponding to the threshold voltage Vth of the driving TFT MD, thereby compensating for the driving transistor's threshold voltage Vth. Therefore, the brightness may be made more uniform regardless of positions of the pixel 20.

Further, in the conventional light emitting display of FIG. 3, the equivalent parasitic capacitors CP1 and CP2 formed in each pixel 20 may still decrease picture quality. Referring to FIG. 3, in the pixel 20 connected to the $n^{th}$ data line Dn, the first parasitic capacitor CP1 is formed between the storage capacitor Cst and the $n^{th}$ data line Dn, and the second parasitic capacitor CP2 is formed between the anode of the organic light emitting device OLED and the $n^{th}$ data line Dn.

Hence, in the pixel 20 connected to the $n^{th}$ data line Dn, the first and second parasitic capacitors CP1 and CP2 are connected to the $n^{th}$ data line Dn. Thus, when a data signal is supplied to the data line Dn in response to the selection signal, the first and second parasitic capacitors CP1 and CP2 may vary the voltage applied to the pixel 20, thereby deteriorating picture quality. Further, because the first and second parasitic capacitors CP1 and CP2 of FIG. 1 or FIG. 3 may have one tenth or more of the capacity of the storage capacitor Cst, a large variation may occur in the voltage applied to the pixels 10 and 20, as FIG. 5 and FIG. 6 show.

SUMMARY OF THE INVENTION

The present invention provides a light emitting display that may have decreased parasitic capacitance.

Additional features of the invention will be set forth in the description which follows, and in part will be apparent from the description, or may be learned by practice of the invention.

The present invention discloses a light emitting display including a plurality of scan lines, a plurality of data lines crossing the scan lines, a plurality of pixels defined by the scan lines and the data lines, and a light emitting device formed on a pixel and comprising a first electrode and a second electrode. A pixel connected to an $n^{th}$ data line includes a switching transistor that turns on in response to a selection signal supplied from a scanline, a storage capacitor to store a voltage corresponding to a data signal supplied from the $n^{th}$ data line when the switching transistor is turned on, and a driving transistor to supply a current to the first electrode. The storage capacitor is formed between the first electrode and an $(n+1)^{th}$ data line.

The present invention also discloses a light emitting display including a plurality of scan lines, a plurality of data lines crossing the scan lines, a plurality of pixels defined by the scan lines and the data lines, and a light emitting device formed on a pixel and comprising a first electrode and a second electrode. A pixel connected to an $n^{th}$ data line includes a driving transistor to supply a current corresponding to a data signal to the first electrode, a first switching part controlled by a first selection signal and comprising a compensation capacitor to compensate for a threshold voltage of the driving transistor, a storage capacitor to store a voltage corresponding to the data signal, and a second switching part to transmit the data signal to the storage capacitor in response to a second selection signal. The storage capacitor is formed between the first electrode and an $(n+1)^{th}$ data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Hereinafter, exemplary embodiments of the present invention will be described with reference to the accompanying drawings.

Figure 7:
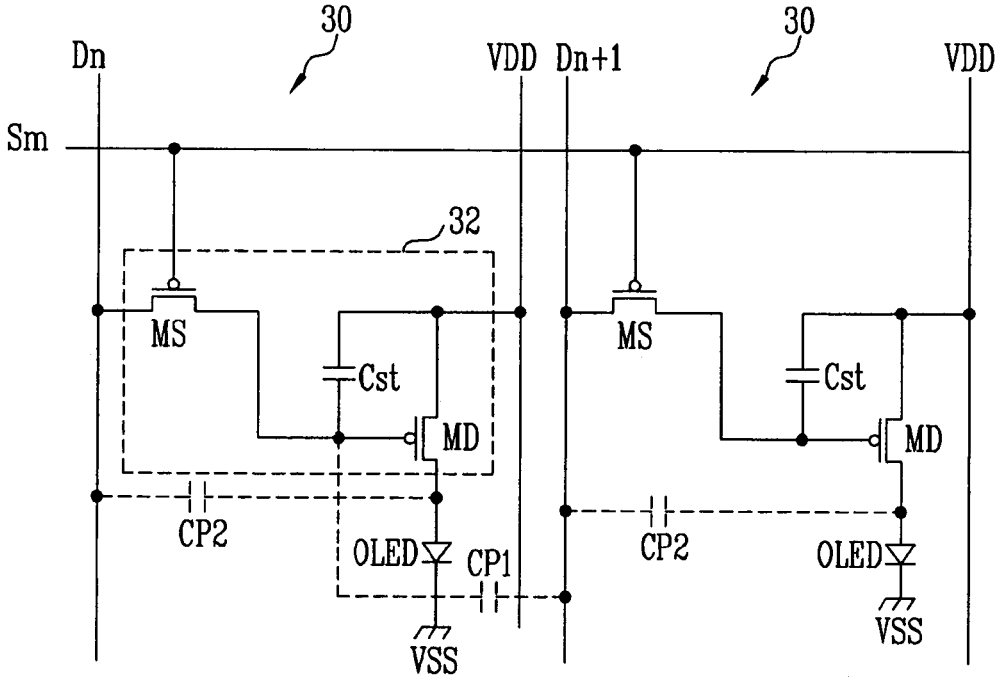
FIG. 7 is a circuit diagram of a pixel in a light emitting display according to a first exemplary embodiment of the present invention.

FIG. 7 is a circuit diagram of a pixel in a light emitting display according to a first exemplary embodiment of the present invention.

Referring to FIG. 7, the light emitting display may include a plurality of pixels 30 receiving a data signal from a data line Dn in response to a selection signal of a scan line Sm and emitting light corresponding to the received data signal.

Each pixel 30 may comprise an organic light emitting device OLED, the data line Dn, the scan line Sm, and a pixel circuit 32 connected to an anode of the organic light emitting device OLED.

The organic light emitting device OLED comprises the anode connected to the pixel circuit 32, a cathode connected to a second power line VSS, and an emitting layer between the anode and cathode. The emitting layer comprises at least a light emitting layer, and it may further include an electron transport layer between the emitting layer and the cathode and a hole transport layer between the emitting layer and the anode. The emitting layer may further comprise an electron injection layer and a hole injection layer. In such an organic light emitting display OLED, when a voltage is applied between the anode and the cathode, electrons generated from the cathode move to the emitting layer via the electron injection layer and the electron transport layer, and holes generated from the anode move to the emitting layer via the hole injection layer and the hole transport layer. Then, the electrons and the holes recombine in the emitting layer, thereby causing light to be emitted.

The pixel circuit 32 comprises a driving TFT MD connected between the first power line VDD and the organic light emitting device OLED; a switching TFT MS connected to the driving TFT MD, the data line Dn and the scan line Sm; and a storage capacitor Cst connected between gate and source electrodes of the driving TFT MD. In the first embodiment, the driving TFT MD and the switching TFT MS are shown as P-type MOSFETs, but the invention is not limited thereto.

The switching TFT MS comprises a gate electrode connected to the scan line Sm, a source electrode connected to the data line Dn, and a drain electrode connected to a first terminal of the storage capacitor Cst. Here, the switching TFT MS turn on in response to the selection signal of the scan line Sm, and it supplies the data signal from the data line Dn to the storage capacitor Cst, which stores a voltage corresponding to the supplied data signal.

The driving TFT MD comprises the gate electrode connected to the first terminal of the storage capacitor Cst, the source electrode connected to a second terminal of the storage capacitor Cst and the first power line VDD, and a drain electrode connected to the anode of the organic light emitting device OLED. Here, the driving TFT MD supplies a current to the organic light emitting device OLED corresponding to the voltage stored in the storage capacitor Cst, and the organic light emitting device OLED emits light corresponding to the current supplied from the driving TFT MD.

According to the first embodiment of the present invention, parasitic capacitors CP1 and CP2 in each pixel are set to minimize a voltage variance of the pixel 30, which will be described with reference to FIG. 7 and FIG. 8.

Figure 8:
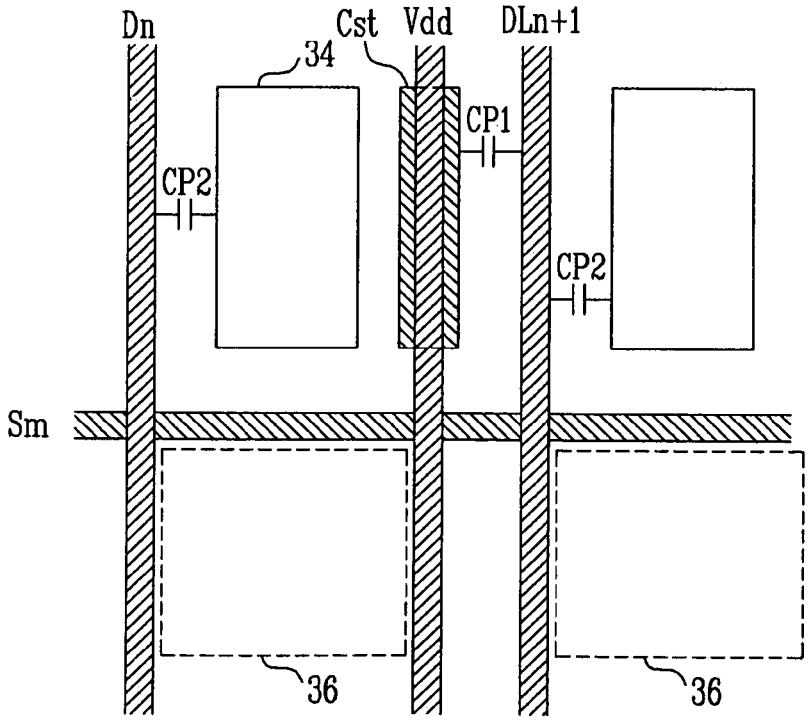
FIG. 8 is a plan view of the pixel in the light emitting display according to the first exemplary embodiment of the present invention.
Figure 9:
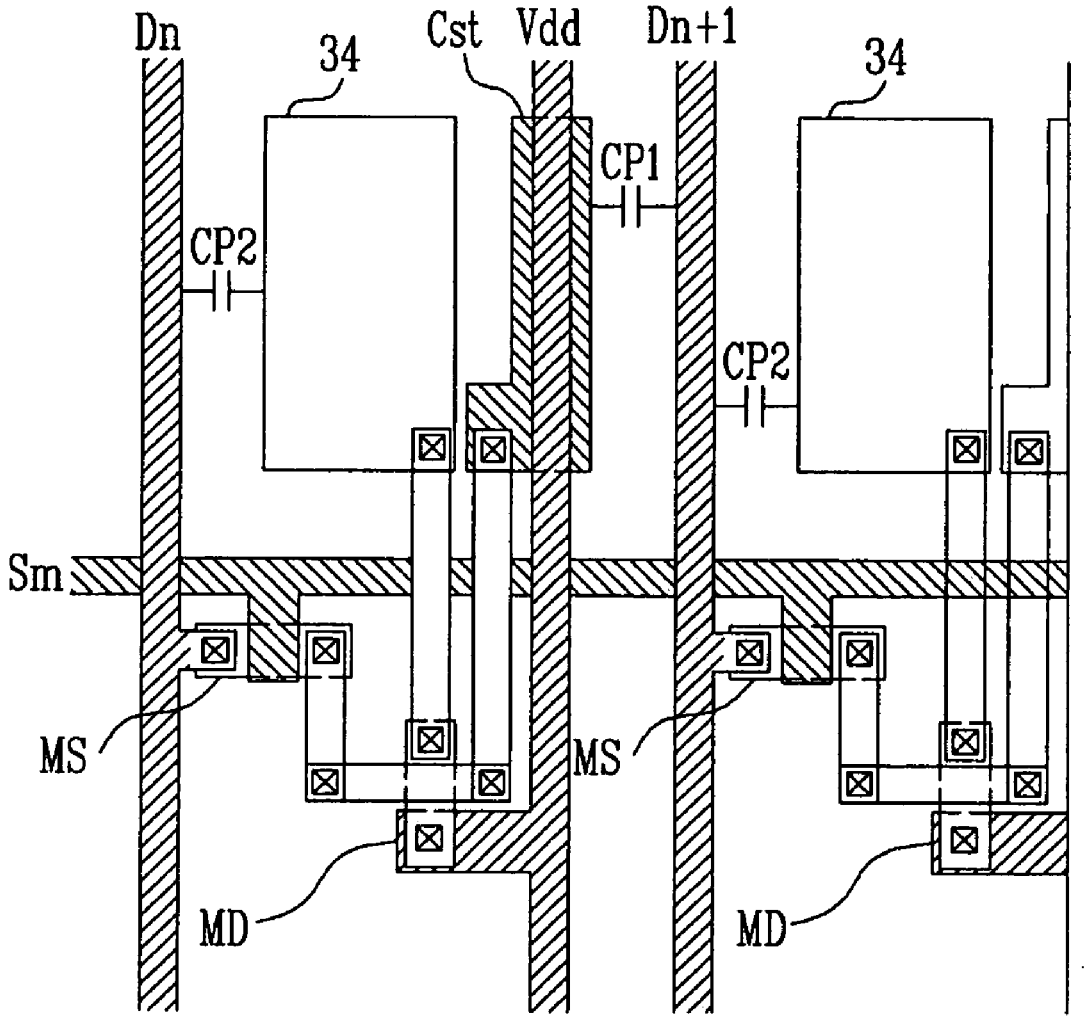
FIG. 9 is a plan view showing TFTs formed in TFT regions of FIG. 8.

Referring to FIG. 8 and FIG. 9, an anode 34 and a storage capacitor Cst may be formed adjacent to a region where the data line Dn and the scan line Sm cross each other. Further, a TFT region 36, in which the driving TFT MD and the switching TFT MS may be formed, may be provided at each intersection of the data line Dn and the scan line Sm.

The anode 34 may be made of a transparent material, such as, for example, indium tin oxide (ITO) or indium zinc oxide (IZO). Further, the anode 34 may overlap with an organic material, and it receives a predetermined current from the pixel circuit 32.

The storage capacitor Cst may be formed in parallel with the data line Dn. Generally, the storage capacitor Cst may be formed by overlapping materials ("gate metal") with the first power line VDD.

As noted above, the TFTs MD and MS may be formed in the TFT region 36. For example, the TFTs MD and MS may be arranged in the TFT region 36 as shown in FIG. 9. Other arrangements may be made considering design, panel resolution, panel size, etc. Alternatively, the TFT region may vary.

According to the first exemplary embodiment of the present invention, a storage capacitor is formed between an anode (i.e., organic light emitting device OLED) and a data line of an adjacent pixel. Thus, as FIG. 8 and FIG. 9 show, a first parasitic capacitor CP1 formed on a pixel 30 connected to the $n^{th}$ data line Dn is connected to the storage capacitor Cst and the $(n+1)^{th}$ data line Dn+1. Further, a second parasitic capacitor CP2 formed on the pixel 30 connected to the $n^{th}$ data line Dn is connected to the anode 34 and the $n^{th}$ data line Dn.

Hence, the first and second parasitic capacitors CP1 and CP2 may be equivalently formed to be connected to different, adjacent data lines Dn+1 and Dn, respectively. Therefore, a voltage variance of the pixel 30 may be minimized. In other words, when the data signal is transmitted to the $(n+1)^{th}$ data line Dn+1, the current may be divided into the first and second parasitic capacitors CP1 and CP2, thereby minimizing the voltage variance of the pixel 30.

According to the first exemplary embodiment of the present invention, the first and second parasitic capacitors CP1 and CP2 may have one tenth or less as much capacity as the storage capacitor Cst. Here, the capacity of the first parasitic capacitor CP1 may be set by adjusting a distance between a data line D and the storage capacitor Cst. Further, the capacity of the second parasitic capacitor CP2 may be set by adjusting a distance between a data line D and the anode 34. Since the first and second parasitic capacitors CP1 and CP2 may have one tenth or less as much as capacity as the storage capacitor Cst, the first and second parasitic capacitors CP1 and CP2 may minimize the voltage variance.

Figure 10:
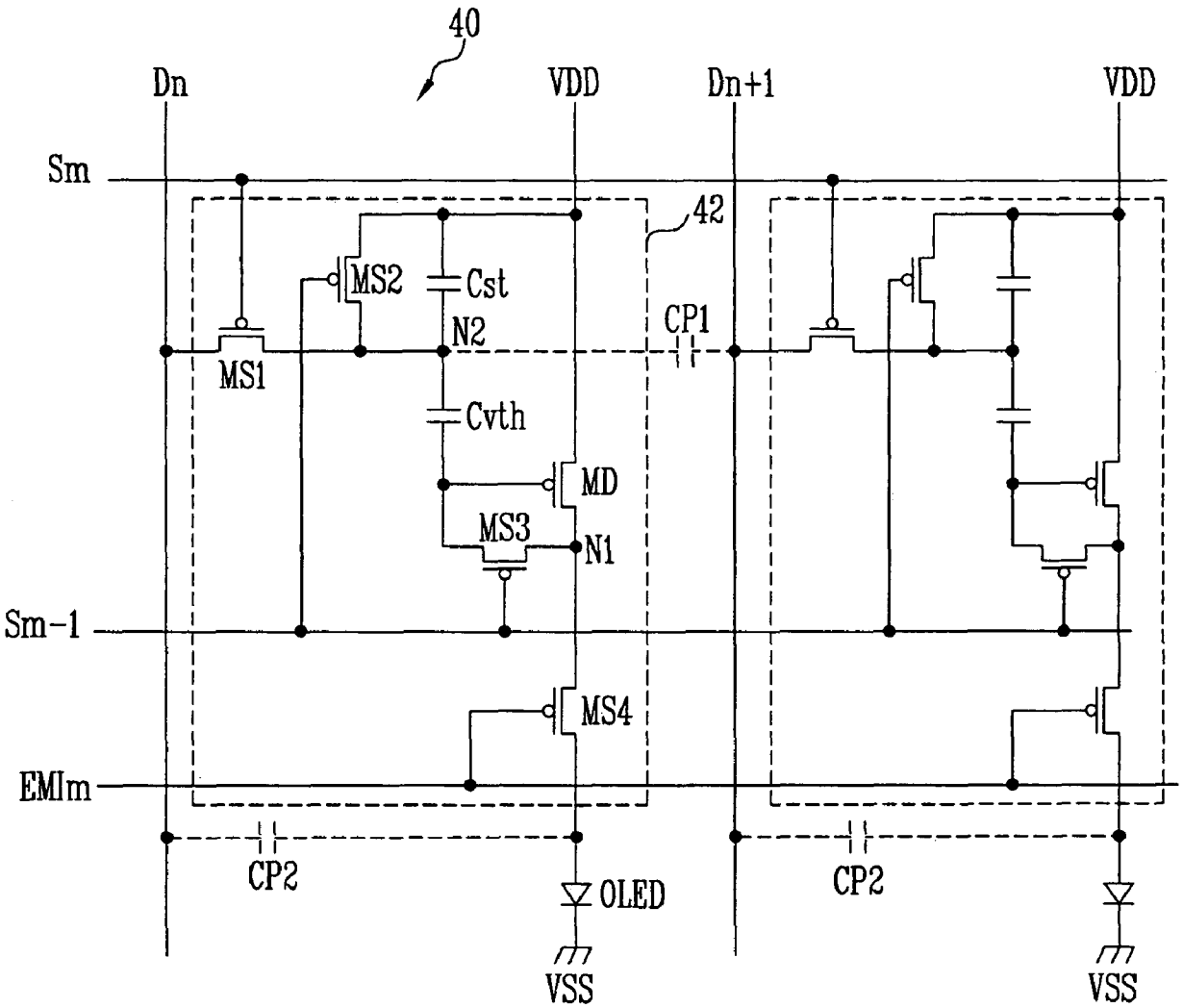
FIG. 10 is a circuit diagram of a pixel in a light emitting display according to a second exemplary embodiment of the present invention.

FIG. 10 is a circuit diagram of a pixel in a light emitting display according to a second exemplary embodiment of the present invention.

Referring to FIG. 10, a pixel 40 according to the second embodiment of the present invention emits light corresponding to a data signal supplied to a data line Dn when a selection signal is transmitted to a scan line Sm.

Each pixel 40 may comprise an organic light emitting device OLED, the data line Dn, the scan line Sm, and a pixel circuit 42 connected to an emitting control line EMIm and driving the organic light emitting device OLED to emit light.

The organic light emitting device OLED comprises an anode connected to the pixel circuit 42 and a cathode connected to a second power line VSS.

The pixel circuit 42 may comprise a driving TFT MD connected between a first power line VDD and the organic light emitting device OLED; a fourth switching device MS4 connected to the emitting control line EMIm, the organic light emitting device OLED and the driving TFT MD; a first switching device MS1 connected to $m^{th}$ scan line Sm and the data line Dn; a second switching device MS2 connected to the first switching device MS1, the first power line VDD and the $(m-1)^{th}$ scan line Sm−1; a third switching device MS3 connected to a first node N1 between the driving TFT MD and the fourth switching device MS4, the $(m-1)^{th}$ scan line Sm−1, and a gate electrode of the driving TFT MD; a storage capacitor Cst connected between the first power line VDD and a second node N2 between the first and second switching devices MS1 and MS2; and a compensation capacitor Cvth connected between the second node N2 and the driving TFT MD. In the second exemplary embodiment, the driving TFT MD and the switching transistors MS1, MS2, MS3 and MS4 are shown as P-type MOSFETs, but the present invention is not limited thereto.

Figure 1:
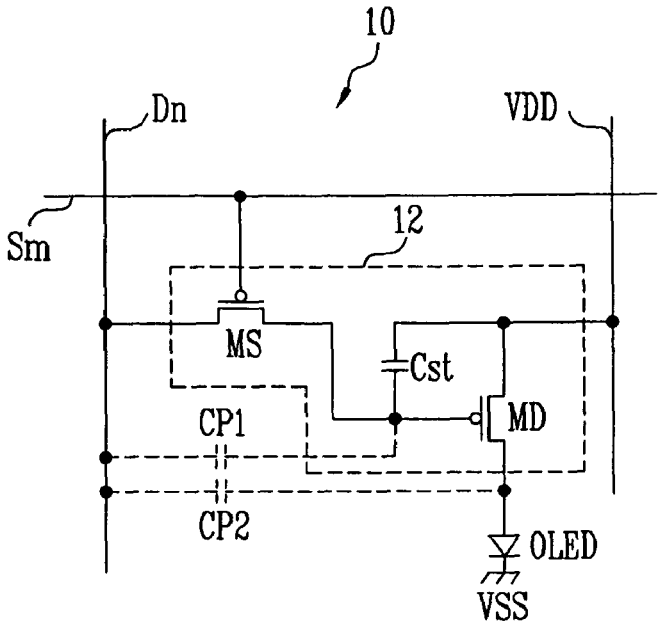
FIG.1 (PRIOR ART)
FIG. 1 is a circuit diagram of a pixel in a conventional light emitting display.
Figure 2:
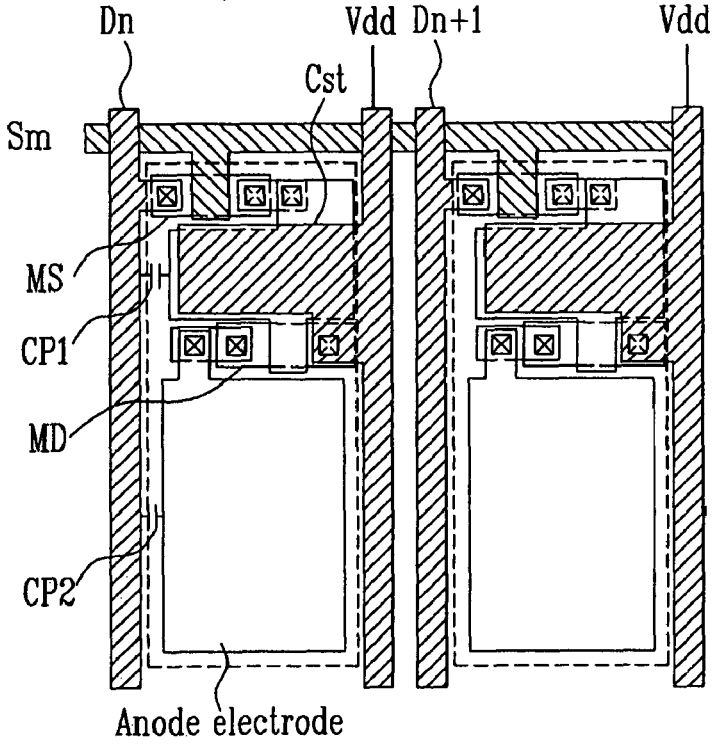
FIG.2 (PRIOR ART)
FIG. 2 is a plan view showing the pixel of FIG. 1.
Figure 3:
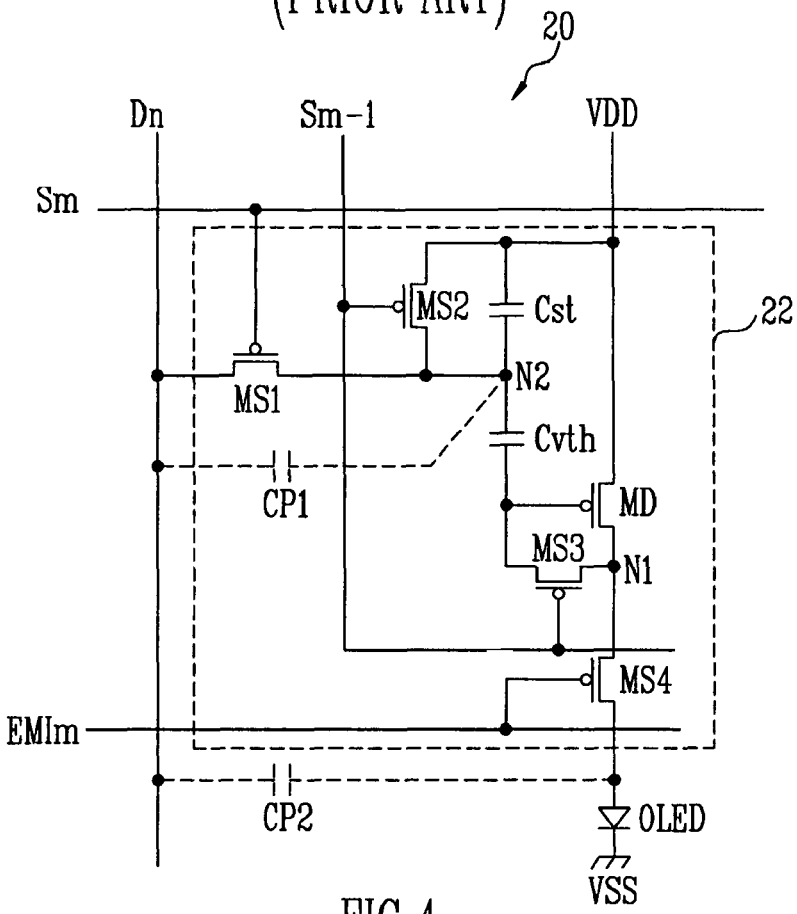
FIG.3 (PRIOR ART)
FIG. 3 is a circuit diagram of a pixel in another conventional light emitting display.
Figure 4:
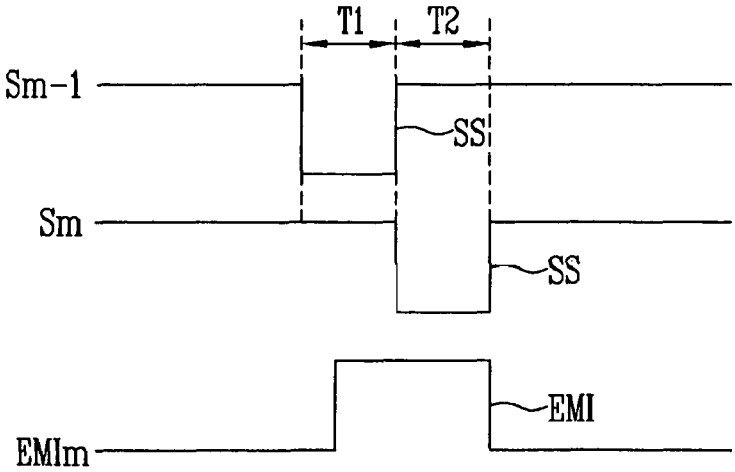
FIG.4 (PRIOR ART)
FIG. 4 illustrates waveforms of driving signals for driving a pixel circuit of FIG. 3.
Figure 5:
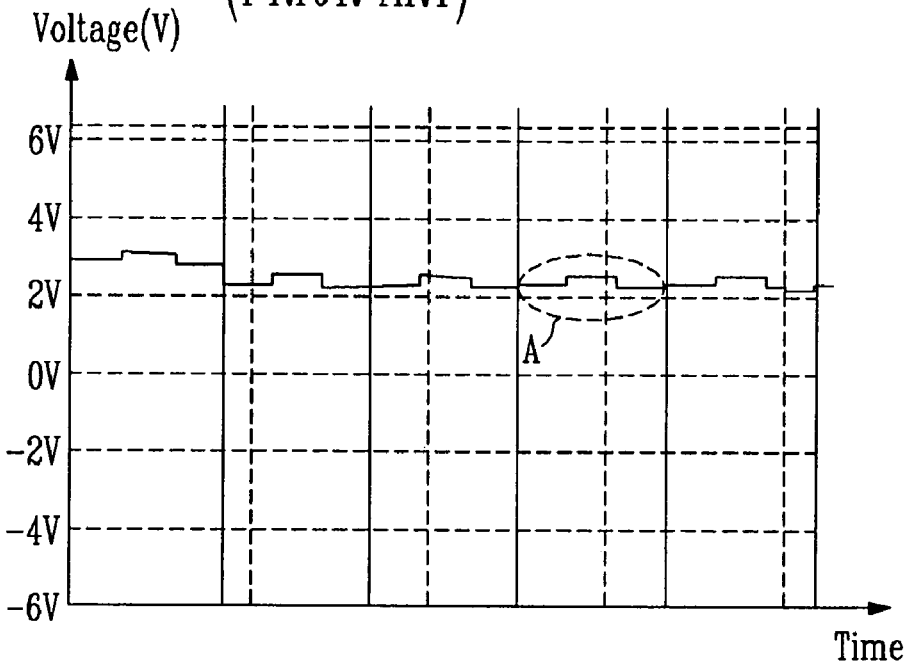
FIG.5 (PRIOR ART)
FIG. 5 is a graph showing a voltage variance in the pixels of FIG. 1 and FIG. 3.
Figure 6:
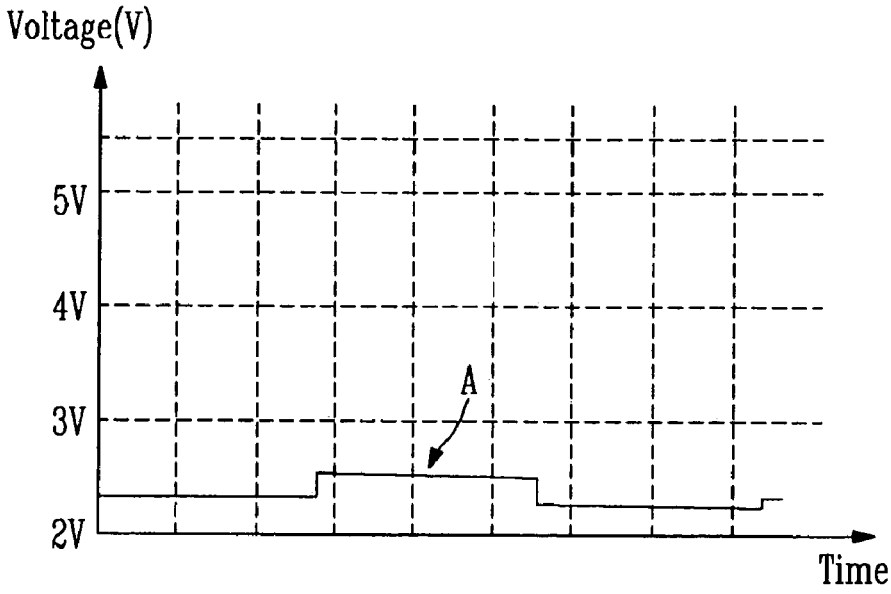
FIG.6 (PRIOR ART)
FIG. 6 is an enlarged view showing portion "A" of FIG. 5.

The pixel 40 may be driven as follows. Referring to FIG. 4, for a period of T1, a low selection signal SS is supplied to the $(m-1)^{th}$ scan line Sm−1 while supplying a high level signal to the $m^{th}$ scan line Sm. Further, a high light emission signal EMI is supplied to the emitting control line EMIm. When supplying the low selection signal SS to the $(m-1)^{th}$ scan line Sm−1, the second and third switching devices MS2 and MS3 are turned on. When supplying the high signal to the $m^{th}$ scan line Sm, the first switching device MS1 is turned off, and when supplying the high light emission signal EMI to the emitting control line EMIm, the fourth switching device MS4 is turned off.

For the period of T1, in which the second and third switching devices MS2 and MS3 are turned on, the driving TFT MD functions as a diode, and a voltage applied between the gate and source electrodes of the driving TFT MD varies until it reaches the threshold voltage of the driving TFT MD. Accordingly, the compensation capacitor Cvth stores a compensation voltage corresponding to the threshold voltage Vth of the driving TFT MD.

For a period of T2, the high level signal is supplied to the $(m-1)^{th}$ scan line Sm−1, and the low selection signal SS is supplied to the $m^{th}$ scan line Sm. Further, the high light emission signal EMI is supplied to the emitting control line EMIm. When supplying the high level signal to the $(m-1)^{th}$ scan line Sm−1, the second and third switching devices MS2 and MS3 are turned off. When supplying the low selection signal SS to the $m^{th}$ scan line Sm, the first switching device MS1 is turned on. When supplying the high light emission signal EMI to the emitting control line EMIm, the fourth switching device MS4 remains turned off.

For the period of T2, in which the first switching device MS1 is turned on, the data signal may be supplied from the data line Dn to the second node N2 through the first switching device MS1, thereby charging the storage capacitor Cst with a voltage corresponding to the data signal. At this time, the gate electrode of the driving TFT MD is supplied with the sum of the voltage (i.e. Vdata-VDD) charged in the storage capacitor Cst and the compensation voltage charged in the compensation capacitor Cvth. That is, in the light emitting display of FIG. 10, the compensation capacitor Cvth is charged with the voltage corresponding to the threshold voltage Vth of the driving TFT MD, thereby compensating for the driving transistor's threshold voltage Vth. Therefore, the brightness may be made more uniform regardless of positions of the pixel 40.

According to the second exemplary embodiment of the present invention, parasitic capacitors CP1 and CP2 provided in each pixel 40 are set to minimize the voltage variance of the pixel 30. This will be described with reference to FIG. 8 and FIG. 10.

Referring to FIG. 8, an anode 34 and a storage capacitor Cst may be formed adjacent to a region where the data line Dn and the scan line Sm cross each other. Further, a TFT region 36, in which the driving TFT MD and the switching TFTs MS1, MS2, MS3 and MS4 may be formed, may be provided at each intersection of the data line Dn and the scan line Sm.

The anode 34 may be made of a transparent material, such as, for example, ITO or IZO. Further, the anode 34 may overlap with an organic material, and it receives a predetermined current from the pixel circuit 42.

The storage capacitor Cst may be formed in parallel with the data line Dn. Generally, the storage capacitor Cst may be formed by overlapping the first power line VDD with the gate metal.

The driving TFT MD and the switching devices MS1, MS2, MS3 and MS4 may be formed in the TFT region 36. Here, the driving TFT MD and the switching devices may have various arrangements considering design, panel resolution, panel size, etc.

According to the second exemplary embodiment of the present invention, a storage capacitor and an anode (i.e., organic light emitting device OLED) are formed with a data line therebetween. Thus, a first parasitic capacitor CP1 formed on a pixel 40 connected to the $n^{th}$ data line Dn is connected to the storage capacitor Cst and the $(n+1)^{th}$ data line Dn+1. Further, a second parasitic capacitor CP2 formed on the pixel 40 connected to the $n^{th}$ data line Dn is connected to the anode 34 and the $n^{th}$ data line Dn.

Hence, the first and second parasitic capacitors CP1 and CP2 may be equivalently formed to be connected to different and adjacent data lines Dn+1 and Dn, respectively. Therefore, a voltage variance of the pixel 40 may be minimized. In other words, when the data signal is transmitted to the $(n+1)^{th}$ data line Dn+1, the current may be divided into the first and second parasitic capacitors CP1 and CP2, thereby minimizing the voltage variance of the pixel 40.

According to the second exemplary embodiment of the present invention, the first and second parasitic capacitors CP1 and CP2 may have one tenth or less as much capacity as the storage capacitor Cst. Here, the capacity of the first capacitor CP1 may be set by adjusting a distance between a data line D and the storage capacitor Cst. Further, the capacity of the second capacitor CP2 may be set by adjusting a distance between a data line D and the anode 34. Since the first and second parasitic capacitors CP1 and CP2 may have one tenth or less as much as capacity as the storage capacitor Cst, the first and second parasitic capacitors CP1 and CP2 may minimize the voltage variance.

Figure 11:
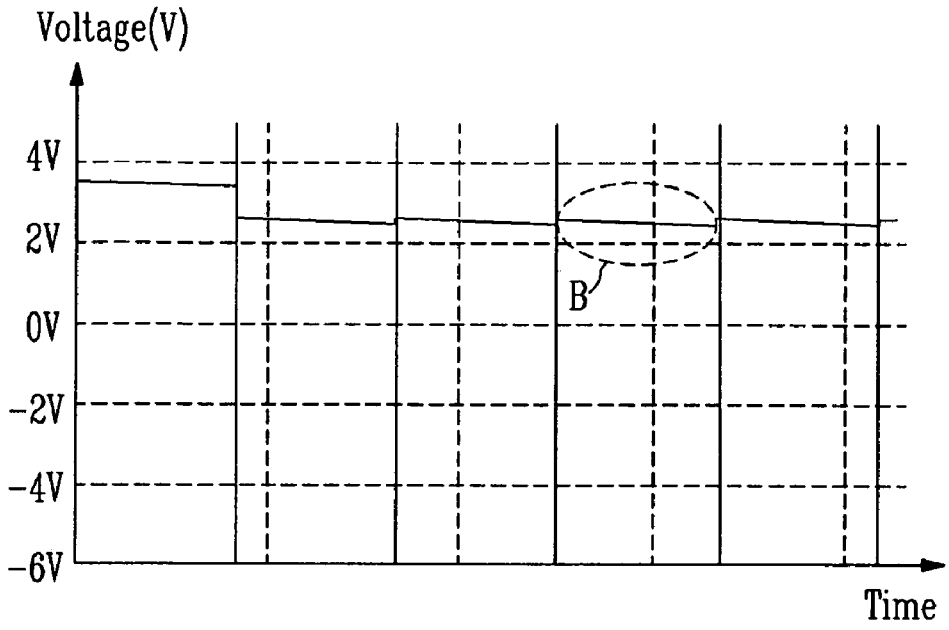
FIG. 11 is a graph showing voltage variance in the pixel of FIG. 7 and FIG. 10.
Figure 12:
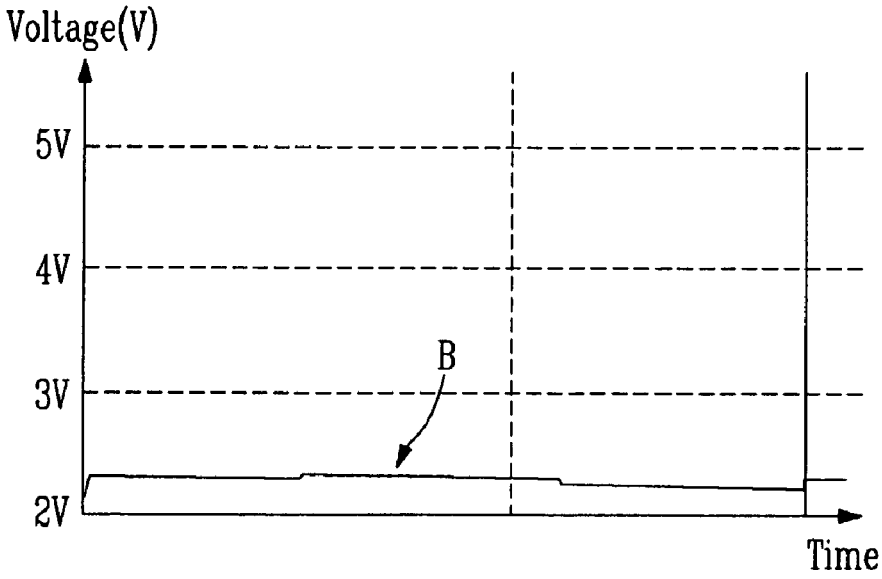
FIG. 12 is an enlarged view showing a portion "B" of FIG. 11.

Generally, in the case where the first and second parasitic capacitors CP1 and CP2 have one tenth or less as much capacity as the storage capacitor Cst, the voltage applied to the pixel 30, 40 may have minimal variation (as shown in FIG. 11 and FIG. 12) even though the data signal of various voltage levels is supplied to the data line D, thereby enhancing the picture quality.

As described above, exemplary embodiments of the present invention provide a light emitting display in which a storage capacitor and an anode of an OLED are formed having a data line therebetween, thereby minimizing voltage variance due to the pixel's parasitic capacitors. According to an exemplary embodiment of the present invention, the parasitic capacitors may have one tenth or less as much capacity as the storage capacitor Cst, thereby enhancing picture quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting display, comprising:

a plurality of scan lines;

a plurality of data lines crossing the scan lines;

a plurality of pixels defined by the scan lines and the data lines; and a light emitting device formed on a pixel and comprising a first electrode and a second electrode, wherein a pixel connected to an $n^{th}$ data line comprises:

a switching transistor that turns on in response to a selection signal supplied from a scan line;

a storage capacitor to store a voltage corresponding to a data signal supplied from the $n^{th}$ data line when the switching transistor is turned on; and a driving transistor to supply a current to the first electrode, the storage capacitor being formed between the first electrode and an $(n+1)^{th}$ data line and not overlapping with the first electrode, wherein the switching transistor and the driving transistor are arranged on a first side of the pixel, and the storage capacitor and the first electrode are arranged on a second side of the pixel, wherein the scan line is arranged between the first side of the pixel and the second side of the pixel, and wherein the switching transistor, the driving transistor, the storage capacitor, and the first electrode are all disposed in the same pixel.

2. The light emitting display of claim 1, wherein the pixel connected to the $n^{th}$ data line further comprises:

a first parasitic capacitor between the first electrode and the $n^{th}$ data line; and a second parasitic capacitor between the storage capacitor and the $(n+1)^{th}$ data line.

3. The light emitting display of claim 2, wherein a distance between the first electrode and the $n^{th}$ data line is set so that a capacity of the first parasitic capacitor is one tenth or less of a capacity of the storage capacitor.

4. The light emitting display of claim 2, wherein a distance between the storage capacitor and the $(n+1)^{th}$ data line is set so that a capacity of the second parasitic capacitor is one tenth or less of a capacity of the storage capacitor.

5. The light emitting display of claim 1, wherein the first electrode is an anode of the light emitting device.

* * * * *